US010801124B2

(12) United States Patent
Iai et al.

(10) Patent No.: US 10,801,124 B2
(45) Date of Patent: Oct. 13, 2020

(54) STAINLESS STEEL PLATE

(71) Applicant: ABEL CO., LTD., Yao-shi, Osaka (JP)

(72) Inventors: Hideki Iai, Yao (JP); Kosuke Iai, Yao (JP); Yoshikazu Aoki, Yao (JP)

(73) Assignee: ABEL CO., LTD., Yao-Shi, Osaka (JP)

( * ) Notice: Subject to any disclaimer, the term of this patent is extended or adjusted under 35 U.S.C. 154(b) by 0 days.

(21) Appl. No.: 15/127,448

(22) PCT Filed: Mar. 27, 2015

(86) PCT No.: PCT/JP2015/059779
§ 371 (c)(1),
(2) Date: Sep. 20, 2016

(87) PCT Pub. No.: WO2015/147301
PCT Pub. Date: Oct. 1, 2015

(65) Prior Publication Data

US 2017/0130355 A1 May 11, 2017

(30) Foreign Application Priority Data

Mar. 28, 2014 (JP) ..... 2014-068144

(51) Int. Cl.
*C25D 11/34* (2006.01)
*C25D 11/38* (2006.01)
(Continued)

(52) U.S. Cl.
CPC ..... *C25D 11/34* (2013.01); *C22C 30/00* (2013.01); *C22C 38/00* (2013.01); *C22C 38/001* (2013.01);
(Continued)

(58) Field of Classification Search
CPC ..... C23C 16/18; C25D 5/12; C25D 9/04
See application file for complete search history.

(56) References Cited

U.S. PATENT DOCUMENTS 3,912,503 A * 10/1975 Schumacher ..... C22C 38/001 420/42
2004/0231393 A1* 11/2004 Mega ..... C21D 8/0226 72/365.2

FOREIGN PATENT DOCUMENTS

JP S49-28540 A 3/1974
JP S55119174 A * 7/1979
(Continued)

OTHER PUBLICATIONS

JP2011179097-A—Bib data and translation; Sep. 2011; Iso, Hideki.*
Bib Data and Translation; JPS55119174A; Ookubo Takahiro, Asahino Yoshio; Mar. 7, 1979 (Year: 1979).*

*Primary Examiner* — Humera N. Sheikh
*Assistant Examiner* — Elizabeth D Ivey
(74) *Attorney, Agent, or Firm* — Rabin & Berdo, P.C.

(57) ABSTRACT

A stainless steel plate for press forming includes a stainless steel having a recess formed along grain boundaries on a base surface of the stainless steel; and a surface film that is formed on a surface of the stainless steel that includes the recess, that is composed of at least one of an Fe and Cr-based oxide film and an Fe and Cr-based hydroxide film, and that has a thickness of equal to or greater than 0.1 μm and equal to or less than 3.0 μm, wherein a groove is formed correspondingly to the recess on the surface side of the stainless steel. The stainless steel plate has superior galling resistance and press formability during press forming even if general-purpose stainless steel and an extreme pressure additive, such as a non-chlorine-based additive, or a low viscosity press oil are used.

3 Claims, 3 Drawing Sheets

(51) Int. Cl.

| | |
|---|---|
| ***C22C 38/44*** | (2006.01) |
| ***C25D 9/06*** | (2006.01) |
| ***C25D 9/10*** | (2006.01) |
| ***C22C 38/00*** | (2006.01) |
| ***C22C 38/22*** | (2006.01) |
| ***C23C 22/24*** | (2006.01) |
| ***C22C 38/40*** | (2006.01) |
| ***C22C 30/00*** | (2006.01) |

(52) U.S. Cl.

CPC ..... *C22C 38/22* (2013.01); *C22C 38/40* (2013.01); *C22C 38/44* (2013.01); *C23C 22/24* (2013.01); *C25D 9/06* (2013.01); *C25D 9/10* (2013.01); *C25D 11/38* (2013.01)

(56) References Cited

FOREIGN PATENT DOCUMENTS

| | | | | |
|---|---|---|---|---|
| JP | H06-264255 | A | | 9/1994 |
| JP | H07-166397 | A | | 6/1995 |
| JP | H10-60663 | A | | 3/1998 |
| JP | 2004-060009 | A | | 2/2004 |
| JP | 2007-277618 | A | | 10/2007 |
| JP | 2008-019491 | A | | 1/2008 |
| JP | 4519482 | B2 | | 8/2010 |
| JP | 4519483 | B2 | | 8/2010 |
| JP | 2011-179097 | A | | 9/2011 |
| JP | 2011179097 | A | * | 9/2011 |

* cited by examiner (A)

(B)

RESULTS OF ELEMENTAL ANALYSIS OF SURFACE FILM AND OTHERS

STAINLESS STEEL PLATE

TECHNICAL FIELD

The present invention relates to stainless steel plates, and more particularly, to a stainless steel plate that exhibits excellent die galling resistance (seizure resistance) and press formability during press forming. Examples of the stainless steel plate include cold rolled stainless steel sheets in sheet form and cold rolled stainless steel strips in roll form.

BACKGROUND ART

Stainless steels have low thermal conductivity and therefore tend to undergo seizure with a pressing die during press forming, which results in wear of the die and consequently increased costs. Measures that have been taken to prevent this problem include using a chlorinated or sulfurized extreme pressure additive for the press oil and increasing the viscosity of the press oil.

Patent Document 1 (Japanese Patent Application Laid-Open No. H10-60663) discloses a technology for metal sheets such as stainless steel sheets, and the technology is intended to improve press formability and other properties of a metal sheet by forming an Fe—Ni—O-based film on at least one main surface of the metal sheet. This technology is based on the belief that the decrease in press formability and other properties of stainless steel sheets is attributable to the hard oxide film on the surface, which resulted from the high content of alloying elements such as Cr, and the technology takes a measure to prevent the decrease by forming an Fe—Ni—O-based film on at least one main surface. This technology indicates that the formation of the Fe—Ni—O-based film reinforces the lubricant components adsorbed on the surface of the film, and therefore attributes the improvement in press formability merely to an increase in slidability.

Patent Document 2 (Japanese Patent Application Laid-Open No. 2004-60009) discloses a technology related to a ferritic stainless steel plate having excellent press formability and a production method for the same. The technology is intended to improve press formability of ferritic stainless steels by forming a surface film having a frictional coefficient $\mu$ of not greater than 0.21. In Example of this technology, a solid lubricating coating (e.g., acrylic, epoxy, or urethane) was applied as the surface film.

Patent Document 3 (Japanese Patent No. 4519482) relates to a highly seizure resistant ferritic stainless steel plate for automotive exhaust system components and a production method for the same. The technology is intended to achieve excellent seizure resistance by forming an oxide film including a Cr—Mn-based oxide having a thickness of 50 to 500 nm on the surface of the ferritic stainless steel and controlling the surface roughness. In this technology, formation of the oxide film is carried out by heat treatment in an oxygen atmosphere.

Patent Document 4 (Japanese Patent No. 4519483) relates to a highly seizure resistant ferritic stainless steel plate and a production method for the same. The technology is intended to achieve excellent seizure resistance by forming an oxide film including a Cr—Mn-based oxide having a thickness of 50 to 500 nm on the surface of the ferritic stainless steel and controlling the surface roughness. In this technology as well, formation of the oxide film is carried out by heat treatment in an oxygen atmosphere, but the treatment is carried out under conditions different from the conditions in Patent Document 3.

PRIOR-ART DOCUMENT

Patent Document

Patent Document 1: Japanese Patent Application Laid-Open No. H10-60663

Patent Document 2: Japanese Patent Application Laid-Open No. 2004-60009

Patent Document 3: Japanese Patent No. 4519482

Patent Document 4: Japanese Patent No. 4519483

SUMMARY OF INVENTION

Problems to be Solved by the Invention

Of the measures using the press oil described above, the former measure poses problems such as environmental issues related to dioxin for example and decreased corrosion resistance. Of the measures using the press oil described above, the latter measure poses the problem of an enormous increase in costs for the degreasing step after press forming.

The technology disclosed in Patent Document 1 requires the use of highly viscous lubricant (press oil) components to improve die galling resistance and press formability of a metal sheet.

The technology disclosed in Patent Document 2 may require the formation of a solid lubricating coating to improve die galling resistance and press formability.

The technology disclosed in Patent Document 3 and the technology disclosed in Patent Document 4 both require the specialized stainless steel containing Cr and Mn to form a Cr—Mn-based oxide.

Therefore, there is a need for stainless steel plates, including for example cold rolled stainless steel sheets in sheet form and cold rolled stainless steel strips in roll form, that do not pose the problems described above, i.e., that can be formed from a general-purpose common stainless steel and, even when an extreme pressure additive such as for example a non-chlorinated one is used or a press oil of low viscosity is used, exhibits excellent die galling properties and enables the used press oil to provide its functions sufficiently without becoming depleted on the press surface.

Accordingly, a primary object of the present invention is to provide a stainless steel plate that exhibits excellent galling resistance and press formability during press forming even when the stainless steel plate is formed from a common stainless steel and moreover even when an extreme pressure additive such as for example a non-chlorinated one is used or a press oil of low viscosity is used. This object is achieved by forming a surface film including a Cr oxide (hydroxide) on the surface of the stainless steel.

A further object of the present invention is to provide a stainless steel plate that exhibits even higher galling resistance and press formability during press forming even when the stainless steel plate is formed from a common stainless steel and moreover even when an extreme pressure additive such as for example a non-chlorinated one is used or a press oil of low viscosity is used. This object is achieved by forming a recess along grain boundaries exposed to the surface of the base stainless steel and forming, on the surface, the surface film including a Cr oxide (hydroxide).

Solution to Problem

The present inventors found that forming a surface film made of an Fe and Cr-based oxide and/or an Fe and Cr-based hydroxide with a predetermined thickness on the surface of the stainless steel is effective to improve die galling resistance and press formability during press forming of the stainless steel.

The present inventors also found that a Cr content of not less than 10 atomic % in the above-described surface film is further effective to improve die galling resistance and press formability during press forming of the stainless steel.

Furthermore, the present inventors also found that, by forming a recess along grain boundaries exposed to the surface of the base stainless steel and forming the above-described surface film on the surface of the stainless steel, the surface including the surface of the recess, the following is achieved: a groove in the surface film corresponding to the recess of the stainless steel serves as a press oil supply source during press forming to allow the effect of the press oil to be produced highly effectively to thereby enable significant improvement in die galling resistance and press formability of the stainless steel during press forming.

A stainless steel plate of the present invention is a stainless steel plate including: a stainless steel; and a surface film formed on a surface of the stainless steel, the surface film being made of at least one of an Fe and Cr-based oxide and an Fe and Cr-based hydroxide, the surface film having a thickness of 0.1 μm or greater and 3.0 μm or less.

In the stainless steel plate of the present invention, preferably, the surface film includes 10 atomic % or greater Cr with the balance substantially being Fe, the surface film being at least one of the oxide film and the hydroxide film, the surface film having the thickness of 0.1 μm or greater and 3.0 μm or less.

Furthermore, in the stainless steel plate of the present invention, preferably, a recess is formed along grain boundaries exposed to the surface of the base stainless steel and the surface film is formed on the surface of the stainless steel with the surface including a surface of the recess, so that a groove corresponding the recess is formed on a front side of the surface film, the groove having an opening width of 0.2 μm or greater and 2.0 μm or less and a depth of 0.2 μm or greater and 2.0 μm or less. In this case, the groove is preferably formed such that the width decreases with decreasing distance toward a bottom in a depth direction of the groove. If the average grain size of the stainless steel is greater than 100 μm, the surface texture of the stainless steel after press forming tends to have asperities, which will degrade the appearance, and also, the amount of press oil retained in the groove along the grain boundaries will decrease as a whole, which will in turn decrease the lubrication effect. Thus, the average grain size of the stainless steel is preferably not greater than 100 μm.

In the stainless steel plate of the present invention, the limitations are imposed on the thickness and others of the surface film formed on the surface of the stainless steel. Reasons for the limitations will be described.

If the thickness of the surface film is less than 0.1 μm, seizure is more likely to occur during press forming and therefore die galling is more likely to occur.

On the other hand, if the thickness of the surface film is greater than 3.0 μm, the surface film is more likely to crack during press forming, i.e., the press formability is more likely to deteriorate, and as a result, the corrosion resistance of the press-formed articles will likely decrease and their prices will increase.

In contrast, as in the present invention, when the thickness of the Fe and Cr-based surface film is in the range of 0.1 μm to 3.0 μm inclusive, the die galling resistance and press formability will be improved.

The oxide and the hydroxide, which form the surface film, are each capable of producing a comparable effect of the surface film, and therefore the ratio between them is not limited.

Furthermore, in the stainless steel plate of the present invention, the Cr content in the surface film may be not less than 10 atomic %, and in such a case, the material of the stainless steel plate is significantly differentiated from the materials of common dies compared with the case in which the Cr content in the surface film is less than 10 atomic %, and consequently, the die galling resistance and press formability are improved, and in addition, chlorine ion penetration into the surface film is inhibited and therefore the corrosion resistance is improved.

Furthermore, in the stainless steel plate of the present invention, a recess may be formed along grain boundaries exposed to the surface of the base stainless steel and a groove corresponding to the recesses may be formed in the surface film. If the opening width of the groove is less than 0.2 μm or the depth of the groove is less than 0.2 μm, the requisite amount of retained press oil is difficult to satisfy and therefore the press formability will not be improved compared with the case in which the opening width is not less than 0.2 μm and the depth is not less than 0.2 μm.

On the other hand, in the stainless steel plate of the present invention, if the opening width of the groove is greater than 2.0 μm, the function of the groove as an oil sump for press oil will decrease and therefore the press formability will not be improved compared with the case in which the opening width is not greater than 2.0 μm.

Furthermore, in the stainless steel plate of the present invention, if the depth of the groove is greater than 2.0 μm, the press-formed articles will have asperities on the surfaces and in extreme cases they are more likely to have cracks, compared with the case in which the depth is not greater than 2.0 μm.

In contrast, in the stainless steel plate of the present invention, when the opening width of the groove is in the range of 0.2 μm to 2.0 μm inclusive and the depth of the groove is in the range of 0.2 μm to 2.0 μm inclusive, the requisite amount of retained press oil is easy to satisfy and therefore the function of the groove as an oil sump for press oil is exhibited, the press-formed articles are less likely to have asperities, and the die galling resistance and press formability are improved.

Furthermore, in the stainless steel plate of the present invention, the groove may be formed such that the width decreases with decreasing distance toward the bottom in a depth direction of the groove, e.g., such that the groove has an inverted triangular or inverted trapezoidal cross-sectional shape, and in such a case, saving of the press oil is achieved.

Advantageous Effects of Invention

The present invention provides a stainless steel plate that exhibits excellent galling resistance and press formability during press forming even when the stainless steel is formed from a common stainless steel and moreover even when an extreme pressure additive such as for example a non-chlorinated one is used or a press oil of low viscosity is used. This is achieved by forming a surface film including a Cr oxide (hydroxide) on the surface of the stainless steel.

Furthermore, the present invention provides a stainless steel plate that exhibits even higher galling resistance and press formability during press forming even when the stainless steel is formed from a common stainless steel and moreover even when an extreme pressure additive such as for example a non-chlorinated one is used or a press oil of low viscosity is used. This is achieved by forming a recess along grain boundaries exposed to the surface of the base stainless steel and forming the surface film including a Cr oxide (hydroxide) on the surface.

Since the present invention provides stainless steel plates, including cold rolled stainless steel sheets and cold rolled stainless steel strips, that are less prone to die galling and has excellent press formability, the present invention makes a significant contribution to the metal working industry by improving the service life of pressing dies for example and improving productivity.

The aforementioned object, the other objects, features, and advantages of the present invention will be more apparent from the following detailed description of the invention with reference to the drawings.

DESCRIPTION OF EMBODIMENTS

Figure 1:
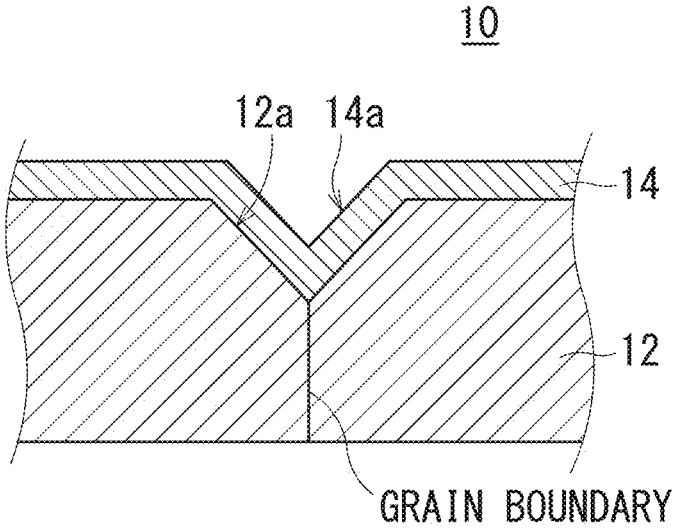
FIG. 1 is a fragmentary cross-sectional view of an exemplary stainless steel plate of the present invention.

FIG. 1 is a fragmentary cross-sectional view of an exemplary stainless steel plate of the present invention. A stainless steel plate 10 illustrated in FIG. 1 includes a stainless steel 12 in a plate shape, for example. The stainless steel 12 may be of any steel grade such as for example austenitic or ferritic, and may be of any surface finish type such as 2D, 2B, BA, hard, or mirror finished, and thus the steel grade and the type of surface finish are not particularly limited. When an austenitic stainless steel is used as the stainless steel, Ni intrusion into the surface film such as an oxide film or a hydroxide film may occur depending on the method used to form the surface film such as an oxide film or a hydroxide film but this does not cause any adverse effect, and therefore the Ni content is not limited.

In addition, in the case of high corrosion resistance stainless steels that have been developed, such as high Cr content and Mo-added ferritic stainless steels and high Cr content, high Ni content, and Mo and N-added high corrosion resistance austenitic stainless steels for example, Mo intrusion into the surface film in these steels, if occurs, does not cause any adverse effect and therefore the Mo content is not limited. However, when a material of a stainless steel has a high Cr, Ni, or Mo content, the workability decreases and the press formability also decreases, and therefore it is preferred that a stainless steel having a composition including not greater than 35% Cr, not greater than 40% Ni, and not greater than 10% Mo be used.

A recess 12*a* is formed in one main surface of the stainless steel 12 along grain boundaries exposed to the surface of the base stainless steel 12. The recess 12*a* has, for example, an inverted triangular shape in cross section or an approximately V shape in cross section. The recess 12*a* can be formed by etching, for example. The recess 12*a* is a depression approximately in a net form made up of junctions and line segments in plan view. The widths, depths, and lengths of the line segments are varied and they may be disconnected at some points.

A surface film 14 is formed on the one main surface of the stainless steel 12, the one main surface including the surface of the recess 12*a*. The surface film 14 is a surface film made of an Fe and Cr-based oxide and/or an Fe and Cr-based hydroxide and having a thickness ranging from 0.1 μm to 3.0 μm inclusive. Furthermore, the surface film 14 may include not less than 10 atomic % Cr with the balance substantially being Fe, the surface film being the oxide film and/or the hydroxide film and having the thickness ranging from 0.1 μm to 3.0 μm inclusive. Such a surface film 14 can be formed on one main surface of the stainless steel 12 in such a manner that, with the other main surface of the stainless steel 12 covered with a protection sheet, the one main surface of the stainless steel 12 is subjected to electrolysis in a surface film-forming aqueous solution that is either an acidic aqueous solution containing sulfuric acid or phosphoric acid or an alkaline aqueous solution containing sodium hydroxide or potassium hydroxide, for example. Electrolyses that may be employed to form the surface film 14 are: alternating current electrolysis technique in which anode electrolysis and cathode electrolysis are alternately performed to form a surface film including an oxide film made of an oxide and a hydroxide film made of a hydroxide; anode electrolysis technique in which anode electrolysis alone is performed to form a surface film including an oxide film made of an oxide; and cathode electrolysis technique in which cathode electrolysis alone is performed to form a surface film including a hydroxide film made of a hydroxide, each electrolysis being performed on the stainless steel 12 in a surface film-forming aqueous solution. Alternatively, the surface film 14 may be formed by immersing the stainless steel 12 in a chromic acid aqueous solution. The surface film 14 serves as a die galling resistance imparting film and also as a lubricant supplying film, and thus the surface film 14 is formed so as to impart die galling resistance and press formability during press forming of the stainless steel.

Formation of the surface film 14 as described above results in formation of a groove 14*a* corresponding to the recess 12*a* on the front side of the surface film 14. The groove 14*a* has, for example, an inverted triangular cross-sectional shape. The groove 14*a* is formed so as to have an opening width ranging from 0.2 μm to 2.0 μm inclusive and a depth ranging from 0.2 μm to 2.0 μm inclusive. The recess 12*a*, surface film 14, and groove 14*a* may be formed by subjecting the one main surface of the stainless steel 12 to electrolysis by alternating current electrolysis technique, anode electrolysis technique, or cathode electrolysis technique in the above-described surface film-forming aqueous solution, or by immersing the stainless steel 12 in the above-described surface film-forming aqueous solution. The groove 14*a* is a depression approximately in an net form made up of junctions and line segments in plan view. The widths, depths, and lengths of the line segments are varied and they may be disconnected at some points.

In the stainless steel plate 10 illustrated in FIG. 1, the limitations are imposed on the thickness and others of the surface film 14 formed on the one main surface of the stainless steel 12. Reasons for the limitations will be described. If the thickness of the surface film 14 is less than 0.1 μm, seizure is more likely to occur during press forming and therefore die galling is more likely to occur.

On the other hand, if the thickness of the surface film 14 is greater than 3.0 μm, the surface film is more likely to crack during press forming, i.e., the press formability is more likely to deteriorate, and as a result, the corrosion resistance of the press-formed articles will more likely decrease and their prices will increase.

In contrast, in the stainless steel plate 10 illustrated in FIG. 1, the thickness of the Fe and Cr-based surface film 14 is within the range of 0.1 μm to 3.0 μm inclusive, and this results in good die galling resistance and press formability.

The oxide and the hydroxide, which form the surface film 14, are each capable of producing a comparable effect of the surface film 14, and thus the ratio between them is not limited.

Furthermore, in the stainless steel plate 10 illustrated in FIG. 1, the Cr content in the surface film 14 is not less than 10 atomic %, and therefore, the material of the stainless steel plate 10 is significantly differentiated from the materials of generally used dies, compared with the case in which the Cr content in the surface film 14 is less than 10 atomic %, and consequently, the die galling resistance and press formability are improved, and in addition, chlorine ion penetration into the surface film 14 is inhibited and therefore corrosion resistance is improved.

Furthermore, in the stainless steel plate 10 illustrated in FIG. 1, if the opening width of the groove 14*a* is less than 0.2 μm or the depth of the groove 14*a* is less than 0.2 μm, the requisite amount of retained press oil is difficult to satisfy and consequently the press formability will not be improved significantly, compared with the case in which the opening width is not less than 0.2 μm and the depth is not less than 0.2 μm.

On the other hand, in the stainless steel plate 10 illustrated in FIG. 1, if the opening width of the groove 14*a* is greater than 2.0 μm, the function of the groove as an oil sump for press oil will decrease and therefore the press formability will not be improved, compared with the case in which the opening width is not greater than 2.0 μm.

Furthermore, in the stainless steel plate 10 illustrated in FIG. 1, if the depth of the groove 14*a* is greater than 2.0 μm, the press-formed articles will have asperities on the surfaces, and in extreme cases, they are more likely to have cracks, compared with the case in which the depth is not greater than 2.0 μm.

In contrast, in the stainless steel plate 10 illustrated in FIG. 1, the opening width of the groove 14*a* is in the range of 0.2 μm to 2.0 μm inclusive and the depth of the groove 14*a* is in the range of 0.2 μm to 2.0 μm inclusive, and as a result, the requisite amount of retained press oil is easy to satisfy and therefore the function of the groove as an oil sump for press oil is exhibited, the press-formed articles are less likely to have asperities on the surfaces, and the die galling resistance and press formability are improved.

Furthermore, in the stainless steel plate 10 illustrated in FIG. 1, the groove 14*a* has an inverted triangular cross-sectional shape such that the width decreases with decreasing distance toward the bottom in a depth direction of the groove 14*a*, and as a result, a greater amount of press oil can be saved than in the case in which the groove is not formed in such a manner.

Consequently, the stainless steel plate 10 illustrated in FIG. 1 can be formed from a general-purpose common stainless steel, and exhibits significantly high galling resistance and press formability during press forming even when an extreme pressure additive such as for example a non-chlorinated one is used or a press oil of low viscosity is used.

Figure 2:
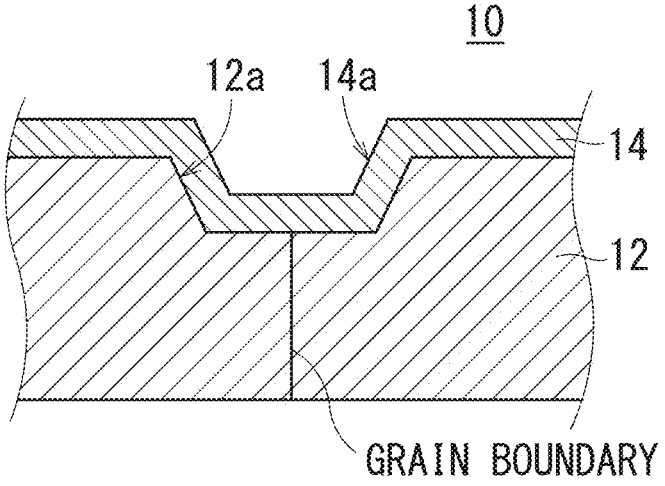
FIG. 2 is a fragmentary cross-sectional view of another exemplary stainless steel plate of the present invention.

FIG. 2 is a fragmentary cross-sectional view of another exemplary stainless steel plate of the present invention. In the stainless steel plate 10 illustrated in FIG. 2, the recess 12*a* formed in the stainless steel 12 and the groove 14*a* formed in the surface film 14 each have an inverted trapezoidal cross-sectional shape unlike the stainless steel plate 10 illustrated in FIG. 1. In other words, the recess 12*a* and the groove 14*a* each have a tapered shape that decreases in width toward the bottom. The stainless steel plate 10 illustrated in FIG. 2 is configured similarly to the stainless steel plate 10 illustrated in FIG. 1 and therefore produces advantageous effects similar to those produced by the stainless steel plate 10 illustrated in FIG. 1.

Experimental Example 1

In Experimental Example 1, plates of SUS304-½ hard, SUS304-BA surface finish, and SUS304-#800 surface finish, each having a thickness of 0.2 mm, were used as samples (stainless steels).

Firstly, in Examples 1-1 to 1-7 and Comparative Examples 1-2, 1-4, and 1-5 each, a surface film including a chromium oxide (hydroxide) was formed on one main surface of the sample using the surface film forming conditions shown in Table 1 (chemical, film forming method classification, and electrolysis conditions) with the thickness of the surface films being varied among the samples.

TABLE 1

| | | | | Electrolysis conditions | | | | | |
|---|---|---|---|---|---|---|---|---|---|
| | Surface finish of stainless steel | Chemical | Film forming method classification | Polarity | Anode time (sec) | Anode current ($A/dm^2$) | Cathode time (sec) | Cathode current ($A/dm^2$) | Reaction time (min) |
| Comparative Example 1-1 | ½ hard | Untreated | — | — | — | — | — | — | — |
| Comparative Example 1-2 | | $H_2SO_4$ 500 g/L | Anode electrolysis | DC | 1200 | 0.02 | — | — | 20 min |
| Example 1-1 | | $H_2SO_4$ 500 g/L | Anode electrolysis | DC | 3000 | 0.04 | — | — | 50 min |
| Example 1-2 | | $CrO_3$ 250 g/L $H_2SO_4$ 500 g/L | Cathode electrolysis | DC | — | — | 7200 | −0.01--0.5 | 120 min |
| Comparative Example 1-3 | BA surface finish | Untreated | — | — | — | — | — | — | — |

TABLE 1-continued

| | Surface finish of stainless steel | Chemical | Film forming method classification | Electrolysis conditions | | | | | |
|---|---|---|---|---|---|---|---|---|---|
| | | | | Polarity | Anode time (sec) | Anode current ($A/dm^2$) | Cathode time (sec) | Cathode current ($A/dm^2$) | Reaction time (min) |
| Comparative Example 1-4 | | $H_2SO_4$ 500 g/L | Alternating current electrolysis | Reverse | 0.1-15 | 0.2-0.5 | 0.1-15 | −0.2--0.5 | 15 min |
| Example 1-3 | | $H_2SO_4$ 500 g/L | Alternating current electrolysis | Reverse | 0.1-15 | 0.2-0.5 | 0.1-15 | −0.2--0.5 | 60 min |
| Example 1-4 | | $CrO_3$ 250 g/L $H_2SO_4$ 500 g/L | Alternating current electrolysis | Reverse | 0.1-15 | 0.1-0.3 | 0.1-15 | −0.2--0.4 | 70 min |
| Comparative Example 1-5 | #800 surface finish | NaOH 40 g/L | Alternating current electrolysis | Reverse | 5 | 0.25 | 15 | −0.25 | 15 min |
| Example 1-5 | | NaOH 40 g/L | Alternating current electrolysis | Reverse | 5 | 1.0 | 10 | −1.0 | 20 min |
| Example 1-6 | | NaOH 40 g/L | Alternating current electrolysis | Reverse | 5 | 1.0 | 10 | −1.0 | 40 min |
| Example 1-7 | | NaOH 40 g/L | Alternating current electrolysis | Reverse | 0.1-15 | 0.3-1.5 | 0.1-15 | −0.3--1.5 | 70 min |

In Table 1, "Chemical" indicates the chemical used in the surface film-forming aqueous solution for forming the surface film. In Table 1, "Film forming method classification" indicates the type of electrolysis used to form the surface film. In Table 1, in "Polarity" in the "Electrolysis conditions" section, "DC" indicates that anode electrolysis was performed but cathode electrolysis was not performed and "Reverse" indicates that anode electrolysis and cathode electrolysis were alternately performed repeatedly. In Table 1, "Anode time" indicates the time of anode electrolysis per operation, "Anode current" indicates the density of the current applied to the stainless steel by the anode electrolysis, "Cathode time" indicates the time of cathode electrolysis per operation, and "Cathode current" indicates the density of the current applied to the stainless steel by the cathode electrolysis. Furthermore, in Table 1, "Reaction time" indicates the total time of the electrolysis process.

On the other hand, in Comparative Examples 1-1 and 1-3, no surface film was formed on one main surface of each sample.

Figure 3:
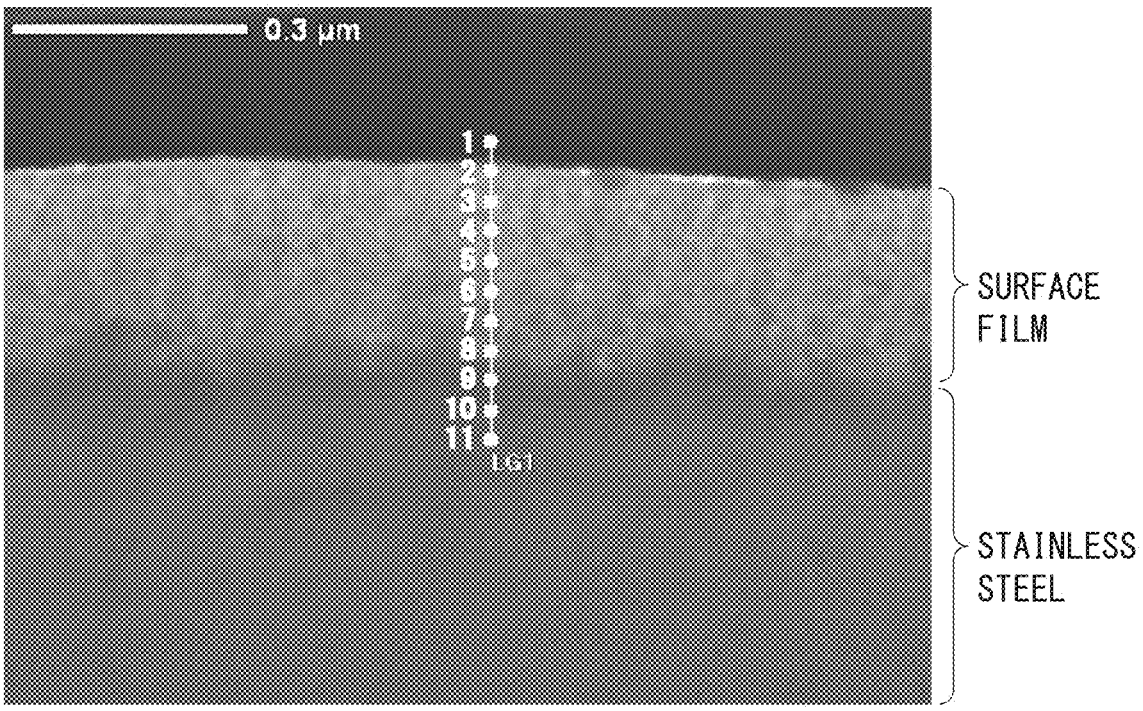
FIG. 3(A) is a bright field image, taken using a transmission electron microscope (JEOL Ltd. JEM-2200 FS), of a cross section of a stainless steel with a surface film formed on its surface in Example 1-1.
FIG. 3(B) is a graph showing results of the elemental analysis.
Figure 3:
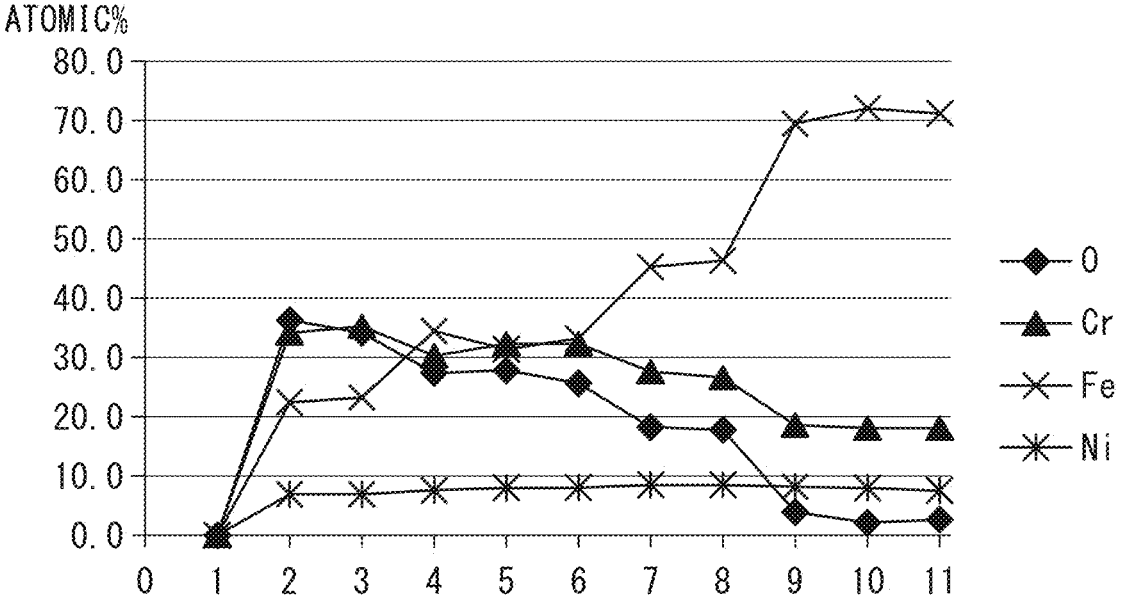

FIG. 3(A) is a bright field image, taken using a transmission electron microscope (JEOL Ltd. JEM-2200 FS), of a cross section of the stainless steel with a surface film formed on its surface in Example 1-1, and FIG. 3(B) is a graph showing results of the elemental analysis. Specifically, as an example of Experimental Example 1, FIG. 3(A) shows a transmission electron microscope image of a focused ion beam-machined cross section of the sample, and FIG. 3(B) shows results of quantitative analysis of the surface film by energy dispersive spectrometry. In this case, for component analysis of the surface film, quantitative analysis by Auger electron spectroscopy was used.

All surface films formed in Experimental Example 1 were made up of about 35 atomic % Cr, about 8 atomic % Ni, with the balance essentially being made up of Fe as a metal component and oxygen as a non-metallic component.

The thicknesses of the formed surface films were measured by sputtering using a radio frequency glow discharge optical emission spectrometer (HORIBA GD-Profiler 2).

Furthermore, as a test method for evaluating die galling resistance, a cylindrical Swift deep drawability test (a Swift cup drawing test) was conducted in Examples 1-1 to 1-7 and Comparative Examples 1-1 to 1-5. The test was conducted with a punch diameter of 40 mm, a punch advance rate of 60 mm/min, a blank holding force of 12 kN, and varied blank diameters of 72 mm, 78 mm, and 84 mm To clarify the difference in seizure occurrence, press oil of low viscosity (25 centistokes) was applied to the surfaces of the samples of Examples 1-1 to 1-7 and Comparative Examples 1-1 to 1-5 for the test to investigate the presence or absence of die galling and others.

The results are shown in Table 2.

TABLE 2

| | Surface film | Blank diameter (mm) | | | | | |
|---|---|---|---|---|---|---|---|
| | | 72 | | 78 | | 84 | |
| | thickness (μm) | Die galling properties | Press formability | Die galling properties | Press formability | Die galling properties | Press formability |
| Comparative Example 1-1 | None | X | X | X | X | X | X |
| Comparative Example 1-2 | 0.08 | X | X | X | X | X | X |

TABLE 2-continued

| | Surface film | Blank diameter (mm) | | | | | |
|---|---|---|---|---|---|---|---|
| | | 72 | | 78 | | 84 | |
| | thickness (μm) | Die galling properties | Press formability | Die galling properties | Press formability | Die galling properties | Press formability |
| Example 1-1 | 0.34 | ○ | ○ | ○ | ○ | ○ | ○ |
| Example 1-2 | 0.54 | ○ | ○ | ○ | ○ | ○ | ○ |
| Comparative Example 1-3 | None | X | X | X | X | X | X |
| Comparative Example 1-4 | 0.05 | X | X | X | X | X | X |
| Example 1-3 | 0.21 | ○ | ◎ | ○ | ◎ | ○ | ○ |
| Example 1-4 | 0.45 | ○ | ◎ | ○ | ◎ | ○ | ○ |
| Comparative Example 1-5 | 0.03 | X | X | X | X | X | X |
| Example 1-5 | 0.15 | ○ | ◎ | ○ | ◎ | ○ | ○ |
| Example 1-6 | 0.28 | ○ | ◎ | ○ | ◎ | ○ | ○ |
| Example 1-7 | 0.56 | ○ | ◎ | ○ | ◎ | ○ | ○ |

In Table 2, as for die galling properties, cases in which die galling did not occur are indicated by "○" and cases in which die galling occurred are indicated by "x", as results of the Swift cup drawing test.

In addition, in Table 2, as for press formability, cases in which complete drawing was accomplished without causing cracking are indicated by "◎", cases in which complete drawing was accomplished but cracking occurred in a corner region of the punch are indicated by "○", and cases in which cracking occurred during drawing and thus drawing was not completed are indicated by "x", as results of the Swift cup drawing test.

In Comparative Examples 1-1 to 1-5, die galling occurred in a corner region of the punch as a result of seizure between the stainless steel plate and the pressing die because of the reduced limiting drawing ratio due to the low viscosity of the press oil used.

In contrast, in all of Examples 1-1 to 1-7 of the present invention, no die galling was observed and the press formability and drawability were good.

Experimental Example 2

In Experimental Example 2, plates of SUS443J1-BA surface finish, SUS443J1-#800 surface finish, SUS304-BA surface finish, and SUS304-#800 surface finish, each having a thickness of 0.3 mm, were used as samples (stainless steels).

Firstly, in one main surface of each sample, grain boundaries were etched in a 5% HCl aqueous solution under conditions including temperatures ranging from room temperature to 60° C. and process times ranging from 1 to 30 minutes to form a recess along the grain boundaries. In this instance, recesses were formed with varied opening widths and depths of the recesses.

Thereafter, in Examples 2-1 to 2-16 and Comparative Examples 2-2 to 2-4 and 2-6 to 2-8 each, a surface film was formed on one main surface of the sample, the main surface including the surface of the recess, under the same conditions as those for Example 1-1 of Experimental Example 1 using varied anode times (reaction times). Accordingly, a groove corresponding to the recess was formed on the front side of each surface film.

On the other hand, in Comparative Examples 2-1 and 2-5, no surface film was formed on one main surface of the sample. Thus, in Comparative Examples 2-1 and 2-5, the recess was regarded as the groove.

Figure 4:
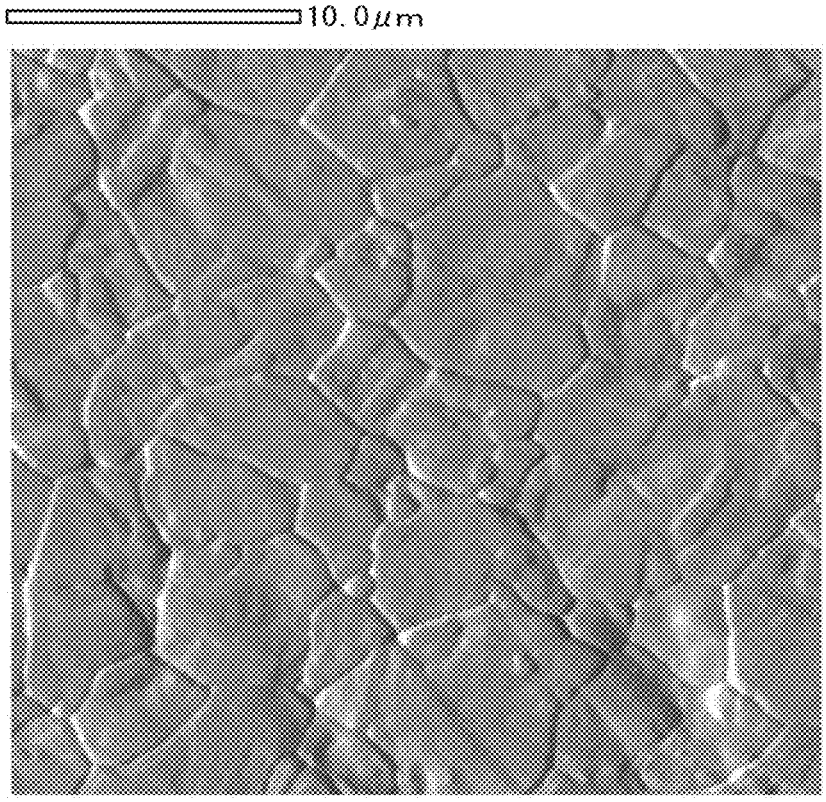
FIG. 4 is a magnification, taken using an atomic force microscope (KEYENCE VN-8010), of a surface of the surface film formed on the surface of a stainless steel in Example 2-1.
Figure 5:
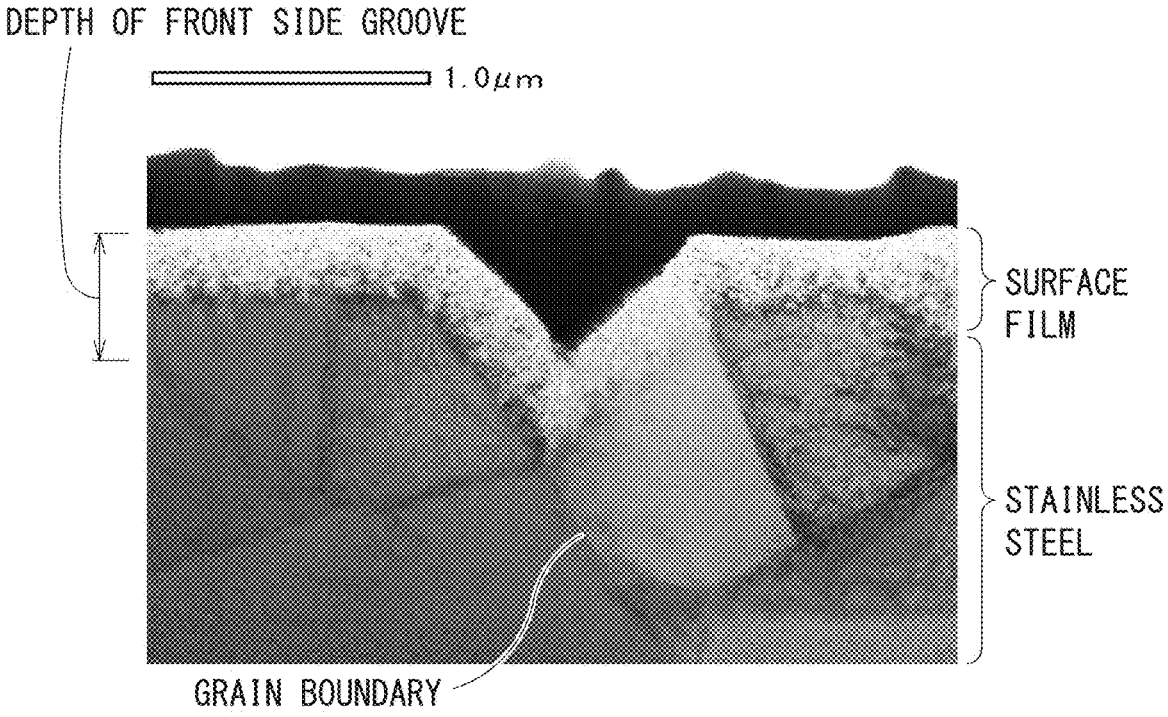
FIG. 5 is a bright field image, taken using the transmission electron microscope (JEOL Ltd. JEM-2200 FS), of a cross section of a stainless steel with a surface film formed on its surface in Example 2-1.

FIG. 4 is a magnification, taken using an atomic force microscope (KEYENCE VN-8010), of a surface of the surface film formed on the surface of the stainless steel in Example 2-1. FIG. 5 is a bright field image, taken using the transmission electron microscope (JEOL Ltd. JEM-2200 FS), of a cross section of the stainless steel with a surface film formed on its surface in Example 2-1. Specifically, as an example of Experimental Example 2, FIG. 4 shows a result of observing the surface of the sample using the atomic force microscope (KEYENCE VN-8010), and FIG. 5 shows a transmission electron microscope image of a focused ion beam-machined cross section of the sample.

The results of quantitative analysis of the elements in the surface films formed in Experimental Example 2 are that SUS443J1 samples each contained about 45 atomic % Cr with the balance substantially being Fe and SUS304 samples had the same results as those of Experimental Example 1.

The thicknesses of the formed surface films were measured by sputtering using the radio frequency glow discharge optical emission spectrometer (HORIBA GD-Profiler 2). Furthermore, the opening widths and the depths of the formed grooves were determined by measurement at 10 measurement points using the atomic force microscope (KEYENCE VN-8010) and calculating the average value of them.

Furthermore, as a press formability test, a Swift cup drawing test was conducted in Examples 2-1 to 2-16 and Comparative Examples 2-1 to 2-8 to determine the limiting drawing ratios. The test was conducted with a punch diameter of 40 mm, a punch advance rate of 60 mm/min, varied blank holding forces of 12 to 20 kN, and varied blank diameters of 72 to 100 mm. In addition, press oil of low viscosity (25 centistokes) was applied to the surfaces of the samples of Examples 2-1 to 2-16 and Comparative Examples 2-1 to 2-8 for the test.

An observation was made on whether or not die galling occurred during the test.

The results are shown in Table 3.

TABLE 3

| | Grade of stainless steel | Surface finish of stainless steel | Surface film thickness (μm) | Dimension of groove (μm) Opening width | Depth | Limiting drawing ratio | Die galling |
|---|---|---|---|---|---|---|---|
| Comparative Example 2-1 | SUS443J1 | BA surface finish | None | 0.10 | 0.05 | 2.15 | Yes |
| Example 2-1 | | | 0.31 | 0.15 | 0.95 | 2.30 | No |
| Example 2-2 | | | 0.35 | 0.80 | 1.25 | 2.40 | No |
| Example 2-3 | | | 1.20 | 1.20 | 1.83 | 2.45 | No |
| Example 2-4 | | | 2.30 | 1.50 | 1.55 | 2.45 | No |
| Comparative Example 2-2 | | | 3.40 | 2.10 | 2.50 | 2.00 | No |
| Comparative Example 2-3 | | #800 surface finish | 0.05 | 0.16 | 0.60 | 2.10 | Yes |
| Example 2-5 | | | 0.45 | 0.85 | 0.45 | 2.45 | No |
| Example 2-6 | | | 0.55 | 1.45 | 0.75 | 2.40 | No |
| Example 2-7 | | | 1.30 | 1.35 | 0.66 | 2.45 | No |
| Example 2-8 | | | 2.50 | 1.60 | 0.77 | 2.45 | No |
| Comparative Example 2-4 | | | 3.80 | 2.20 | 2.60 | 2.00 | No |
| Comparative Example 2-5 | SUS304 | BA surface finish | None | 0.05 | 0.06 | 2.05 | Yes |
| Example 2-9 | | | 0.10 | 1.45 | 1.65 | 2.15 | No |
| Example 2-10 | | | 0.41 | 1.31 | 1.06 | 2.20 | No |
| Example 2-11 | | | 1.60 | 1.44 | 1.51 | 2.20 | No |
| Example 2-12 | | | 2.60 | 1.56 | 1.44 | 2.20 | No |
| Comparative Example 2-6 | | | 3.60 | 2.15 | 2.30 | 2.00 | No |
| Comparative Example 2-7 | | #800 surface finish | 0.08 | 0.01 | 0.03 | 2.00 | Yes |
| Example 2-13 | | | 0.29 | 0.65 | 0.55 | 2.15 | No |
| Example 2-14 | | | 0.32 | 0.57 | 0.85 | 2.20 | No |
| Example 2-15 | | | 1.70 | 0.88 | 0.76 | 2.20 | No |
| Example 2-16 | | | 3.00 | 1.20 | 0.88 | 2.20 | No |
| Comparative Example 2-8 | | | 3.50 | 2.20 | 2.30 | 2.00 | No |

As can be seen from the results in Table 3, in Comparative Examples 2-1, 2-3, 2-5, and 2-7, which had a film thickness of less than 0.1 μm, die galling occurred and the limiting drawing ratios were small. In Comparative Examples 2-2, 2-4, 2-6, and 2-8, which had a film thickness of greater than 3 μm, a groove opening width of greater than 2 μm, and a groove depth of greater than 2 μm, die galling did not occur but the limiting drawing ratios were small.

In contrast, in Examples 2-1 to 2-16 of the present invention, it is clear that die galling did not occur and the limiting drawing ratios were large regardless of the steel grade or the type of surface finish of the stainless steel.

Experimental Example 3

In Experimental Example 3, rolls of SUS304-½ hard (steel strip) having a plate thickness of 0.2 mm and a width of 300 mm were used as samples (stainless steels).

Firstly, in Example 3-1, a surface film including a chromium oxide (hydroxide) and having a thickness was formed on one main surface of the sample under surface film forming conditions shown in Table 4 (chemical, film forming method classification, and electrolysis conditions). In this example, a recess similar to the recess obtained in Experimental Example 2 by etching with HCl was formed along grain boundaries in the surface of the stainless steel and an oxide film was formed on the surface of the stainless steel, the surface including the surface of the recess. This oxide film had a groove formed on the front side thereof correspondingly to the recess. All surface films formed in Experimental Example 3 were made up of about 35 atomic % Cr, about 8 atomic % Ni, with the balance essentially being made up of Fe as a metal component and oxygen as a non-metallic component.

TABLE 4

| | Chemical | Film forming method classification | Electrolysis conditions Polarity | Anode time (sec) | Anode current ($A/dm^2$) | Cathode time (sec) | Cathode current ($A/dm^2$) | Reaction time (min) |
|---|---|---|---|---|---|---|---|---|
| Comparative Example 3-1 | Untreated | — | — | — | — | — | — | — |
| Example 3-1 | $CrO_3$ 250 g/L $H_2SO_4$ 500 g/L | Alternating current electrolysis | Reverse | 0.1-15 | 0.1-0.3 | 0.1-15 | −0.2--0.4 | 70 min |

In Comparative Example 3-1, a ½ hard steel was used in the as-is condition.

In Example 3-1 and Comparative Example 3-1, a Swift cup drawing test was conducted similarly to Experimental Example 2 to determine the limiting drawing ratios and investigate the presence or absence of die galling.

The results are shown in Table 5.

TABLE 5

| | Surface film | Dimension of groove (μm) | | Limiting | |
|---|---|---|---|---|---|
| | thickness (μm) | Opening width | Depth | drawing ratio | Die galling |
| Comparative Example 3-1 | No | 0.01 | 0.01 | 1.45 | Yes |
| Example 3-1 | 0.45 | 0.95 | 0.51 | 1.75 | No |

The results in Table 5 demonstrate that, in Comparative Example 3-1, the press formability was low because of the hardness of the ½ hard steel.

In contrast, in Example 3-1 of the present invention, the limiting drawing ratio was high and no die galling was observed.

Methods used for surface analysis of elements in the surface film and measurement of the thickness of the surface film were the same as those used in Experimental Examples 1 and 2. The surface films of SUS447J1 samples contained about 55 atomic % Cr and about 3 atomic % Mo with the balance substantially being Fe, and the surface films of SUS316L samples contained about 30 atomic % Cr, about 10 atomic % Ni, and about 3 atomic % Mo. The surface films of 23Cr-35Ni-7.5Mo-0.15N stainless steel samples contained about 35 atomic % Cr, about 15 atomic % Ni, and about 5 atomic % Mo.

The measured values of the film thicknesses and the groove shapes are shown in Comparative Examples 4-1 to 4-5 and Examples 4-1 to 4-6 in Table 6. As a press formability test, a Swift cup drawing test was conducted in the comparative examples and the examples to determine the limiting drawing ratios. In the test, the punch diameter was 40 mm, the punch advance rate was 60 mm/min, the blank holding force was varied in the range of 12 kN to 20 kN, and the blank diameter was varied in the range of 60 to 84 mm. In addition, press oil of low viscosity (50 centistokes) was applied as a lubricant to the surfaces of the samples for the test. An observation was made on whether or not die galling occurred during the test. The results are shown in Table 6.

TABLE 6

| | Grade of stainless steel | Surface film thickness (μm) | Dimension of groove (μm) Opening width | Depth | Limiting drawing ratio | Die galling |
|---|---|---|---|---|---|---|
| Comparative Example 4-1 | SUS447J1 | None | 0.10 | 0.04 | 1.55 | Yes |
| Example 4-1 | | 0.35 | 0.30 | 0.35 | 1.80 | No |
| Example 4-2 | | 2.51 | 1.44 | 0.80 | 1.80 | No |
| Comparative Example 4-2 | | 3.44 | 2.50 | 2.20 | 1.50 | No |
| Comparative Example 4-3 | SUS316L | 0.05 | 0.17 | 0.07 | 1.65 | Yes |
| Example 4-3 | | 0.45 | 0.90 | 1.30 | 2.00 | No |
| Example 4-4 | | 1.53 | 1.35 | 1.55 | 2.05 | No |
| Comparative Example 4-4 | | 3.21 | 2.25 | 1.95 | 1.75 | No |
| Comparative Example 4-5 | 23Cr—35Ni—7.5Mo—0.15N | None | 0.05 | 0.04 | 1.55 | Yes |
| Example 4-5 | | 0.65 | 0.90 | 0.65 | 1.85 | No |
| Example 4-6 | | 1.25 | 1.05 | 0.90 | 1.85 | No |

Experimental Example 4

In Experimental Example 4, plates of high corrosion resistant austenitic stainless steels, namely, SUS447J1, SUS316L, and 23Cr-35Ni-7.5Mo-0.15N, each being 2B surface finished and polished with a #400 buff and having a thickness of 0.3 mm, were used as samples.

Firstly, in one main surface of each sample, grain boundaries were etched in a 30% aqua regia solution under conditions including temperatures ranging from room temperature to 60° C. and process times ranging from 1 to 30 minutes to form a recess along the grain boundaries such that the opening widths and depths are varied among the samples.

Subsequently, anode electrolysis was performed in a 500 g/L $H_2SO_4$ aqueous solution under electrolysis conditions including a current density of 0.04 A/dm$^2$ and process times ranging from 10 to 60 minutes to form a surface film on the one main surface. Accordingly, a groove corresponding to the recess was formed on the front side of the surface film.

As can be seen from the results in Table 6, in Comparative Examples 4-1, 4-3, and 4-5, which had film thicknesses of less than 0.1 μm, die galling occurred during press forming and the limiting drawing ratios were small, even with the high Cr content and Mo-added high corrosion resistant stainless steels. In Comparative Examples 4-2 and 4-4, which had film thicknesses of greater than 3 μm, die galling did not occur but the limiting drawing ratios were low and the press formability decreased.

In contrast, it is clear that, in Examples 4-1 to 4-6 of the present invention, die galling did not occur and the limiting drawing ratios were larger than those of the comparative examples regardless of the grade of the stainless steel.

Experimental Example 5

In Experimental Example 5, a plate of SUS443J1-BA surface finish having a thickness of 0.3 mm, which are the same material as that of Experimental Example 2", were used as samples (stainless steels).

Firstly, in Examples 5-1 to 5-9 and Comparative Examples 5-1 to 5-3 each, a surface film was formed on one main surface of the sample, under the same conditions as those for Example 1-3 shown in Table 1 of Experimental Example 1, using varied reaction times. In Examples 5-3, 5-5, and 5-8, prior to formation of the surface film, grain boundaries were etched in a 5% HCl aqueous solution under conditions including a temperature of room temperature and process times ranging from 1 to 30 minutes to form a recess along the grain boundaries.

On the other hand, in Comparative Example 5-1, no surface film was formed on one main surface of the sample.

The results of quantitative analysis of the elements in the surface films formed in Experimental Example 5 indicate that the surface films of the SUS443J1 samples contained about 45 atomic % Cr with the balance substantially being Fe.

The thicknesses of the formed surface films were measured by sputtering using the radio frequency glow discharge optical emission spectrometer (HORIBA GD-Profiler 2). Furthermore, the opening widths and the depths of the grooves were measured using the atomic force microscope (KEYENCE VN-8010) as with Experimental Example 2.

Furthermore, as a press formability test, a Swift cup drawing test was conducted in Examples 5-1 to 5-9 and Comparative Examples 5-1 to 5-3 to determine the limiting drawing ratios. The test was conducted with a punch diameter of 40 mm, a punch advance rate of 60 mm/min, varied blank holding forces in the range of 12 to 20 kN, and varied blank diameters in the range of 72 to 100 mm. In addition, press oil of low viscosity (25 centistokes) was applied to the surfaces of the samples of Examples 5-1 to 5-9 and Comparative Examples 5-1 to 5-3 for the test.

An observation was made on whether or not die galling occurred during the test.

The results are shown in Table 7.

By comparing Example 5-2 against Example 5-3, Example 5-4 against Example 5-5, and Example 5-7 against Example 5-8, a comparison is made on the influence of the groove formed on the front side of the surface film on the limiting drawing ratio and die galling. Examples 5-3, 5-5, and 5-8, in each of which a groove having an opening width of 0.2 to 2 μm and a depth of 0.2 to 2 μm was formed, had a limiting drawing ratio of not less than 2.4, which is higher than the values of Examples 5-2, 5-4, and 5-7, in each of which substantially no groove was formed.

Thus, the groove formed on the front side of the surface film has resulted in an increased limiting drawing ratio and improved press formability.

It should be noted that, in the stainless steel plates 10 illustrated in FIGS. 1 and 2, the recess 12*a* is formed in the stainless steel 12 and the groove 14*a* is formed in the surface film 14, but alternatively, in the present invention, the recess and the groove may not be formed.

Furthermore, in the stainless steel plates 10 illustrated in FIGS. 1 and 2, the recess 12*a* and the surface film 14 are formed only on one main surface of the stainless steel 12, but alternatively, in the present invention, the surface film may be formed on both the one main surface and the other main surface of the stainless steel. In this case, the recess may also be formed on both the one main surface and the other main surface of the stainless steel.

Furthermore, in the stainless steel plates 10 illustrated in FIGS. 1 and 2, the recess 12*a* and the groove 14*a* each have an inverted triangular cross-sectional shape or an inverted trapezoidal cross-sectional shape, but alternatively, in the present invention, the recess and groove may have a different shape. In such a case, when the groove is formed such that the width decreases with decreasing distance toward the bottom in a depth direction of the groove, saving of the press oil is achieved.

TABLE 7

| | Grade of stainless steel | Surface finish of stainless steel | Surface film thickness (μm) | Dimension of groove (μm) Opening width | Depth | Limiting drawing ratio | Die galling |
|---|---|---|---|---|---|---|---|
| Comparative Example 5-1 | SUS443J1 | BA surface finish | None | 0.01 | 0.01 | 2.00 | Yes |
| Comparative Example 5-2 | | | 0.09 | 0.01 | 0.02 | 2.15 | Yes |
| Example 5-1 | | | 0.10 | 0.01 | 0.02 | 2.30 | No |
| Example 5-2 | | | 0.35 | 0.01 | 0.02 | 2.30 | No |
| Example 5-3 | | | 0.34 | 0.85 | 1.10 | 2.40 | No |
| Example 5-4 | | | 1.15 | 0.02 | 0.02 | 2.35 | No |
| Example 5-5 | | | 1.05 | 1.15 | 1.74 | 2.45 | No |
| Example 5-6 | | | 2.50 | 0.03 | 0.02 | 2.30 | No |
| Example 5-7 | | | 2.90 | 0.02 | 0.01 | 2.35 | No |
| Example 5-8 | | | 2.84 | 1.56 | 1.76 | 2.45 | No |
| Example 5-9 | | | 3.00 | 0.01 | 0.01 | 2.30 | No |
| Comparative Example 5-3 | | | 3.20 | 0.02 | 0.03 | 2.00 | No |

As can be seen from the results in Table 7, in Comparative Examples 5-1 and 5-2, which had film thicknesses of less than 0.1 μm, die galling occurred and the limiting drawing ratios were small. In Comparative Example 5-3, which had a film thickness of greater than 3 μm, die galling did not occur but the limiting drawing ratio was small.

In contrast, in Examples 5-1 to 5-9 of the present invention, it is clear that die galling did not occur and the limiting drawing ratios were large.

INDUSTRIAL APPLICABILITY

The stainless steel plate of the present invention can be utilized for press-formed products and other products that are press formed using a die. The present invention provides stainless steel plates, including cold rolled stainless steel sheets and cold rolled stainless steel strips, that are less prone to die galling and has excellent press formability, and therefore the present invention makes a significant contribution to the metal working industry by improving the service life of pressing dies for example and improving productivity.

REFERENCE SIGNS LIST

10 stainless steel plate
12 stainless steel
12*a* recess
14 surface film
14*a* groove

The invention claimed is:

1. A stainless steel plate for press forming, comprising:

a stainless steel;

a recess formed along grain boundaries on a base surface of the stainless steel; and a surface film comprising an Fe and Cr-based oxide and an Fe and Cr-based hydroxide on a surface of the stainless steel plate including a surface of the recess, the surface film having a thickness which is equal to or more than 0.1 μm and equal to or less than 3.0 μm, wherein a groove corresponding to the recess is formed on a front side of the surface film, the groove having an opening width of 0.2 μm or greater and 2.0 μm or less and a depth of 0.2 μm or greater and 2.0 μm or less, the groove is a depression approximately in a net form made up of junctions and line segments in a plan view, the groove having an inverted triangular cross-sectional shape or an inverted trapezoidal cross-sectional shape such that a width of the groove decreases with decreasing distance toward a bottom in a depth direction of the groove, the recess is a depression approximately in a net form made up of junctions and line segments in a plan view, the recess having an inverted triangular cross-sectional shape or an inverted trapezoidal cross-sectional shape such that a width of the recess decreases with decreasing distance toward a bottom in a depth direction of the recess, and the stainless steel plate is press formed using press lubricant oil.

2. The stainless steel plate according to claim 1, wherein the surface film comprises 10 atomic % or greater Cr with the balance substantially being Fe and O, the surface film consists of at least one of the Fe and Cr-based oxide and the Fe and Cr-based hydroxide, and the surface film has a thickness equal to or more than 0.1 μm and equal to or less than 3.0 μm.

3. The stainless steel plate according to claim 1, wherein the groove is formed such that a width thereof decreases toward a bottom in a depth direction of the groove, to retain press oil employed during press forming of the stainless steel plate.

* * * * *